United States Patent [19]

Bratt et al.

[11] 4,249,377

[45] Feb. 10, 1981

[54] TEMPERATURE SENSING DEVICE FOR A HOT GAS ENGINE HEATER HEAD

[76] Inventors: Jan C. Bratt, Gamlebäcksgatan 18, S-216 21 Malmö; Stefan Lorant, Oshögavägen 130, S 230 30 Oxie; Kjell A. Pettersson, Hjortrogatan 28, S-234 00 Lomma, all of Sweden

[21] Appl. No.: 971,877

[22] Filed: Dec. 21, 1978

[51] Int. Cl.[3] ..... F02G 1/04

[52] U.S. Cl. ..... 60/517; 60/524; 73/359 R

[58] Field of Search ..... 60/517, 523, 524; 236/69; 73/359 R

[56] References Cited

U.S. PATENT DOCUMENTS

| | | | |
|---|---|---|---|
| 2,564,097 | 8/1951 | Rinia et al. | 60/524 |
| 3,956,892 | 5/1976 | Nystrom | 60/524 |
| 4,075,844 | 2/ 978 | Schiferli | 60/524 |

*Primary Examiner*—Allen M. Ostrager
*Assistant Examiner*—Stephen F. Husar
*Attorney, Agent, or Firm*—Finnegan, Henderson, Farabow, Garrett & Dunner

[57] ABSTRACT

An improved hot gas engine heater head where a thermocouple is coaxially positioned in an isolation tube having one closed end and the isolation tube is coaxially positioned in one of a plurality of heater tubes forming a part of a working gas path between two variable volume chambers and traversing a combustion gas flow path. The thermo-couple is in heat-transfer contact with the working gas and is physically isolated from the working and combustion gases. The temperature signal from the thermo-couple is conducted by a conduction wire passing through heat insulating material such that neither the thermo-couple nor the conduction wire is exposed directly to the working gas or the combustion gas.

3 Claims, 2 Drawing Figures

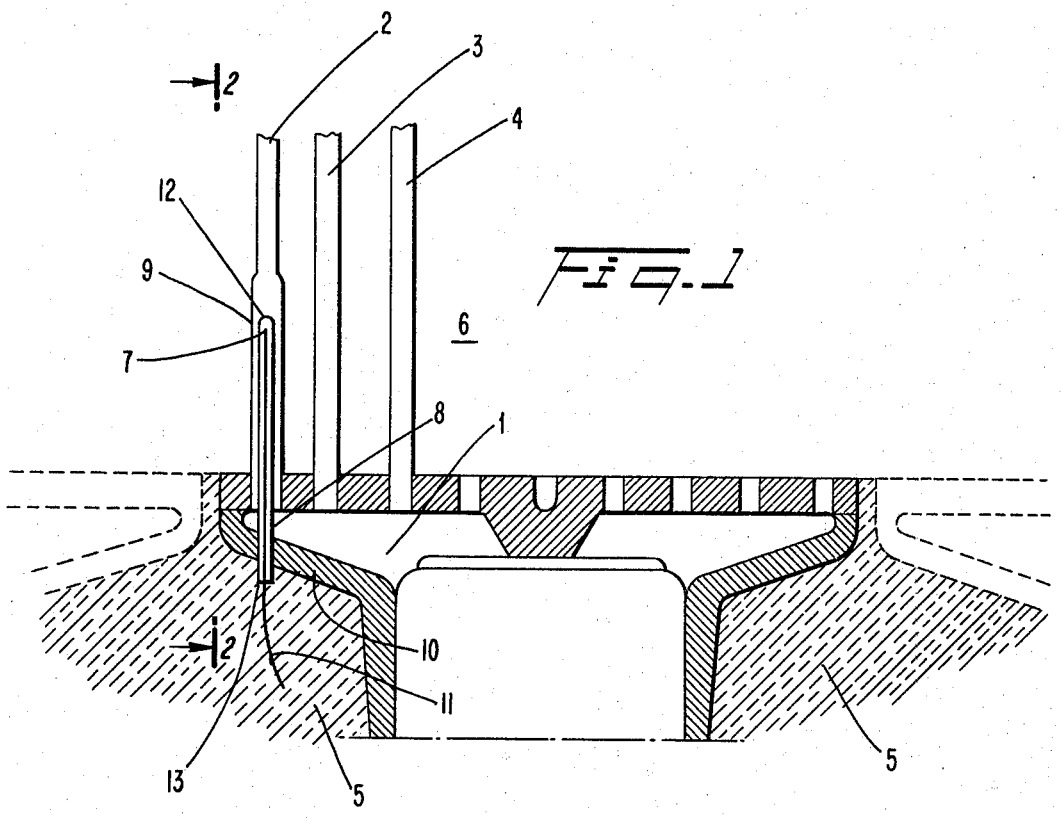
Fig. 1
Fig. 2
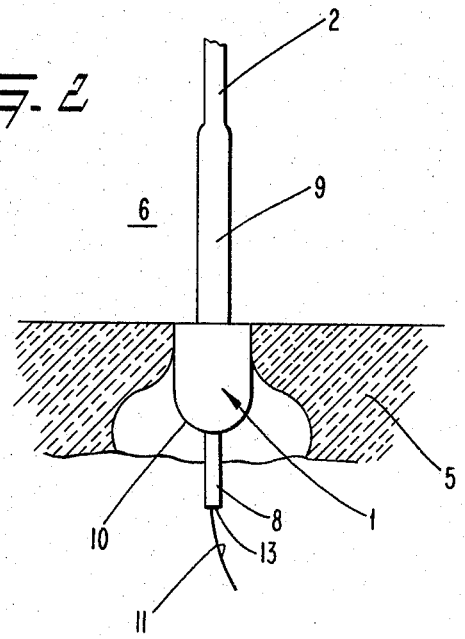

TEMPERATURE SENSING DEVICE FOR A HOT GAS ENGINE HEATER HEAD

BACKGROUND OF THE INVENTION

1. Field of the Invention

The invention relates to a temperature sensing device for measuring the temperature of working gas in the heater tubes of a hot gas engine heater head. More particularly, the invention relates to a thermo-couple placed in but isolated from the working gas for measuring its temperature while reducing error caused by exposure to the working gas.

2. Description of the Prior Art

Heater heads of hot gas engines, such as the Stirling cycle engine heater head disclosed in U.S. Pat. No. 4,069,670, are provided with temperature sensing devices to measure the temperature of the hot working gas in the heater head or of the wall of the heater head. The temperature of the working gas in the heat exchange pipes or heater pipes of the heater head is measured to provide a parameter for control of other engine parameters such as air/fuel ratio or power output.

Thermo-couples are the most commonly used temperature sensing devices, but their use is restricted to avoid error caused by the environment in which they are placed. For example, thermo-couples have been placed within one or more of the heater tubes to measure the working gas temperature, as disclosed in U.S. Pat. No. 3,835,648. The drawback of such a location for a thermo-couple is the detrimental effect the working gas may have on the thermo-couple. A thermo-couple of the type that measures actual temperature range is adversely influenced by hydrogen, a common element in the working gas of hot gas engines.

The thermo-couple, however, cannot be used outside the heat exchange tubes or heater tubes without protection because of the combustion gases. Providing protection for the thermo-couple may induce an error in temperature measurement.

Furthermore, the temperature signal conduction wire leading to the thermo-couple must be protected from extreme temperatures and, therefore, cannot pass through the combustion gases to reach thermo-couples mounted outside the heater tubes.

The present invention overcomes the disadvantages of the prior art by providing a temperature sensing device which is isolated from gases and extreme temperatures beyond those intended to be sensed, which may adversely effect its reliability or accuracy.

SUMMARY OF THE INVENTION

In accordance with the invention, as embodied and broadly described herein, a hot gas engine heater head including a plurality of heater tubes extending into a combustion gas flow path and being part of a working gas path between two variable volume chambers, the heater tubes being connected to one side of a manifold, the opposite side of the manifold being embedded in heat-insulating material, is improved. The improvement comprises thermo-couple means for measuring the temperature of the working gas, the thermo-couple means being in heat-transfer contact with the working gas and being physically isolated from the working gas and the combustion gas to minimize error in temperature measurement.

Preferably, the thermo-couple means includes an isolation tube having a closed end extending coaxially into one of the heater tubes and a thermo-couple coaxially positioned in the isolation tube, the other end of the isolation tube being mounted in a gas-tight connection with the embedded side of the manifold, the isolation tube being filled with a heat-transfer medium.

It is also preferred that the diameter of the heater tube be increased to receive the isolation tube and to permit working gas flow in the heater tube around the isolation tube.

Additionally, it may be preferred to embed the temperature signal conduction wire connected to the thermo-couple in the heat-insulating material.

BRIEF DESCRIPTION OF THE DRAWINGS

FIG. 1 is a cross-sectional view of one manifold of the heater head with the thermo-couple of the invention in place.

FIG. 2 is an end view of the manifold of FIG. 1 along line 2—2.

DESCRIPTION OF THE PREFERRED EMBODIMENT

Reference will now be made in detail to the present preferred embodiment of the invention, an example of which is illustrated in the accompanying drawings.

In FIGS. 1 and 2, one manifold 1 of a hot gas engine heater head similar to that disclosed in U.S. Pat. No. 4,069,670 is shown with a plurality of heat exchange tubes or heater tubes 2,3,4 extending from one side of manifold 1 into the combustion gas flow path 6. The heater tubes 2,3,4 are part of a working gas path between two variable volume chambers, one of which is in fluid communication with the manifold 1 and the other of which is not depicted. The opposite side 10 of the manifold 1 is embedded in heat-insulating material 5.

In accordance with the invention, the heater head is provided with an improvement comprising a thermo-couple means for measuring the temperature of the working gas, the thermo-couple means being in heat-transfer contact with the working gas and being isolated from the working gas and the combustion gas to minimize error in temperature measurement.

In the preferred embodiment, depicted in FIGS. 1 and 2, the thermo-couple means includes an isolation tube 8 having a closed end 12 extending coaxially into a heater tube 2. The opposite end 13 of the isolation tube 8 is mounted in a gas-tight connection with the side 10 of the manifold 1 embedded in heat-insulating material 5. The isolation tube 8 may be secured to the manifold 1 by brazing or any other means to provide a gas tight seal.

A thermo-couple 7 is coaxially positioned in and proximate the closed end 12 of the isolation tube 8 for measuring the temperature of the working gas flowing through the heater tube 2.

The isolation tube 8 is preferably filled with heat-transfer medium such as normal atmospheric air for conducting the working gas temperature to the thermo-couple 7. The thermo-couple may be of any appropriate commercially-available type such as a platinum-platinum/rhodium thermo-couple which may be calibrated to provide the temperature of the working gas based on the temperature of the heat transfer medium.

Since the thermo-couple 7 does not come into contact with the working gas in the heater tube 2 because of the isolation tube 8, the risk of error in the temperature signal is significantly reduced and there is no contamination of the thermo-couple by the high-temperature working gases, particularly those containing hydrogen.

Preferably, for at least a portion of its length, the diameter of the heater tube is increased to receive the isolation tube and to permit working gas to flow in the heater tube around the isolation tube. As here embodied and depicted in FIGS. 1 and 2, a portion 9 of the heater tube 2 connected to the manifold 1 has an increased diameter to receive the isolation tube 8 and to permit the working gas to flow through the heater tube 2 around the isolation tube 8.

It is also preferred that the temperature signal conduction wire connected to the thermo-couple passes from the open end of the isolation tube through the heat-insulating material.

In the embodiment depicted in FIGS. 1 and 2, the temperature signal conduction wire 11 extends from the thermo-couple 7 through the other end 13 of the isolation tube 8 into the heat-insulating material 5. In this manner, the wire 11 is not exposed to any extreme temperatures outside the isolation tube 8. Thus, the risk of error in the temperature signal is significantly reduced.

It will be apparent to those skilled in the art that various modifications and variations can be made to the temperature sensing device of the present invention without departing from the scope or spirit of the invention. It is intended, therefore, that the present invention cover the modifications and variations which come within the scope of the appended claims and their equivalents.

What is claimed is:

1. In a hot gas engine heater head wherein a working gas path between two variable volume chambers includes one side of a manifold and a plurality of heater tubes connected to the one side of the manifold and extending into a combustion gas flow path, the opposite side of the manifold being embedded in heat-insulating material, the improvement comprising:

an isolation tube having a closed end extending coaxially into one of said heater tubes and a thermo-couple coaxially positioned in said isolation tube, the other end of the isolation tube being mounted in a gas-tight connection with the embedded side of the manifold, said isolation tube being filled with a heat-transfer medium.

2. The improvement of claim 1 wherein the diameter of said heater tube is increased to receive said isolation tube and to permit working gas flow in said heater tube around said isolation tube.

3. In a hot gas engine heater head wherein a working gas path between variable volume chambers includes a plurality of heater tubes extending from one side of a manifold and into a combustion gas flow path, the opposite side of the manifold being embedded in heat-insulating material, the improvement comprising:

an isolation tube having a closed end extending coaxially into one of said heater tubes and a thermo-couple coaxially positioned in said isolation tube, the other end of the isolation tube being mounted in a gas-tight connection with the embedded side of the manifold, said isolation tube being filled with a heat-transfer medium, and a temperature signal conduction wire connected to the thermo-couple passing from the open end of the isolation tube through said heat-insulating material.

* * * * *